United States Patent [19]

Lopata et al.

[11] Patent Number: 4,689,185

[45] Date of Patent: Aug. 25, 1987

[54] PRIMING METHOD FOR RIMFIRE CARTRIDGE

[75] Inventors: Frances G. Lopata, Clayton; George C. Mei, Creve Coeur, both of Mo.

[73] Assignee: Olin Corporation, Stamford, Conn.

[21] Appl. No.: 889,688

[22] Filed: Jul. 25, 1986

[51] Int. Cl.[4] ..... C06D 1/08; F42B 3/00

[52] U.S. Cl. ..... 264/3.4; 86/17; 86/20.1; 86/20.14; 86/20.15; 86/30; 86/32; 102/205; 102/315; 102/441; 149/39; 149/105; 264/3.6

[58] Field of Search ..... 86/17, 1.1, 20 R, 20 A, 86/20 B, 20 C, 29, 30, 32, 39, 40, 41, 43; 149/105, 39; 102/204, 205, 315, 441; 264/3.4, 3.6

[56] References Cited

U.S. PATENT DOCUMENTS

| | | | |
|---|---|---|---|
| 40,772 | 12/1863 | Sharns | 86/32 |
| 90,871 | 6/1869 | Powers | 86/32 |
| 814,378 | 3/1906 | Johnson | 102/501 |
| 1,075,202 | 10/1913 | Fidjeland | 102/501 |
| 2,662,818 | 12/1953 | Schuricht | 86/32 |
| 4,247,494 | 1/1981 | Carter | 102/204 |
| 4,405,392 | 9/1983 | Hobbs et al. | 149/24 |
| 4,412,492 | 11/1983 | Knight et al. | 102/204 |
| 4,432,819 | 2/1984 | Carter et al. | 102/204 |
| 4,608,102 | 8/1986 | Krampen et al. | 149/37 |

*Primary Examiner*—Peter A. Nelson
*Assistant Examiner*—Howard J. Locker
*Attorney, Agent, or Firm*—Bruce E. Burdick

[57] ABSTRACT

A priming method for rimfire cartridges is disclosed in which a propellant solution is disposed adjacent a centrifugally located primer material in a rimfire cartridge. The solvent is then evaporated to leave a propellant film near the primer material in order to provide slower, more uniform ignition to thereby allow use of propellant powders which would otherwise be too fast or too sensitive.

7 Claims, 1 Drawing Figure

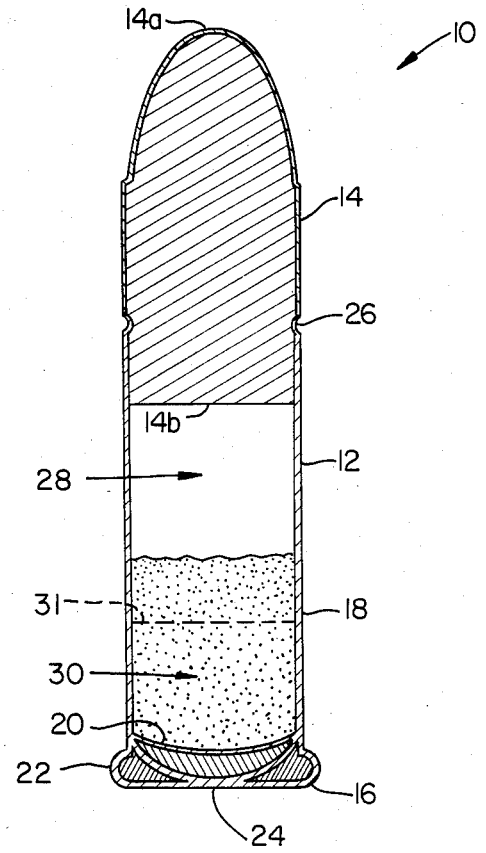
14a
10
14
26
14b
12
28
31
18
30
20
22
16
24

PRIMING METHOD FOR RIMFIRE CARTRIDGE

This invention was developed under government contract No. DAAK10-85-C-0034, but the assigneee has elected to retain title to the patent. The invention may be used by or for the U.S. Government without payment of royalty.

This invention relates to priming methods for ammunition.

BACKGROUND AND SUMMARY OF THE INVENTION

There is international concern about the amount of airborne toxic materials found in shooting ranges, particularly airborne lead. For example, the Federal Government of West Germany has set the maximum permissible work-place concentration of lead dust at 0.1 mg of lead per cubic meter of air. During tests at German and non-German shooting ranges, equipped with various types of ventilation systems, concentrations of up to 9 mg of lead per cubic meter were measured over exposures of 4–6 hours when conventional, fully jacketed 9×19 mm Luger (parabellum) ammunition was used. High concentrations of airborne lead are also found in some indoor shooting ranges using .22 caliber ammunition. The main problem is thought to come from the lead styphnate and barium nitrate used in the priming compositions.

One attempt to solve the above problem for centerfire ammunition (which has primer cup or Berdan primer placed in the center of the cartridge base) has been the "Sintox" primer developed by Dynamit Nobel of Troisdorf, West Germany which is thought to use an amorphous dinol initiating explosive mixed with zinc and titanium compounds rather than lead or barium compounds. However, that priming composition is not suitable for priming rimfire cartridges because it does not easily flow into the rim of the cartridge during the priming procedure. Also, rimfire primer mixes must have much higher sensitivity than centerfire primer mixes and it is thought that "Sintox" does not have sufficient sensitivity for use in .22 caliber rimfire. Dinol having a smaller crystalline size than that of the "Sintox" primer was made and was tried by applicant's predecessors at Olin Corporation about 40 years ago, but that mix contained lead in forms of lead thiocyanate an lead peroxide and is thus not suitable as a lead-free primer mix. Thus, a need remains for a lead-free primer mix for .22 caliber rimfire cartridges.

Also of concern is the bullet. Caliber .22 bullets are conventionally made of lead which is sometimes plated with copper for aesthetic reasons. There is a concern that some of the airborne lead found in indoor shooting ranges may be caused by vaporization of the lead base of the bullet, frictional wear during passage of the bullet through the barrel or air and/or "dusting" (or minute fragmentation of the lead bullet) upon impact of the lead bullet with the target or backstop. Copper bullets, aluminum bullets and other non-lead bullets are known as a solution to the concern about airborne lead from the bullet.

A solution to this problem of needing a sensitive lead-free, non-toxic .22 caliber rimfire primer has been long sought after. Rimfires have been in existence for many many years without such a primer having been found. It is well known that rimfire priming mixes must have a considerably greater sensitivity than that required by centerfire primers, so even if a low sensitivity lead-free centerfire primer mix is found, it is not obvious how to make a high sensitivity lead-free, non-corrosive, non-toxic rimfire priming mix. The phase "Non-toxic" as used herein means consisting essentially of materials which are not heavy metals such as lead or barium and not known carcinogens or poisons, especially when vaporized, burnt or exploded as in the firing of an ammunition round. "Lead-free" as used herein means having no lead except for insignificant impurities. "Non-corrosive" as used herein means not containing halogens and thus producing any significant combustion products which are corrosive to iron or steel barrels. The problem is such that the U.S. Government's Army Research and Development Center issued a contract to Olin to study the feasibility of developing such a primer.

A solution to the above problem is achieved by the present invention which provides a priming method for producing rimfire cartridges, which includes the steps of introducing a quantity of non-toxic, non-corrosive, lead free priming material into an empty rimfire ammunition shell case; spinning the shell case so as to centrifugally force the priming material into a rim of the rimfire shell case; introducing a quantity of propellant into the interior of the base of the shell case adjacent to the centrifugally located primer material and then densifying and stabilizing the position of the densified propellant sufficiently that it will remain adjacent to the priming material until the priming material is detonated; introducing a quantity of loose propellant powder into the interior of the shell case forward of the priming material and densified propellant material; sealing the open end of the shell case so as to confine the loose propellant there within.

The invention will be better understood by reference to the attached drawing in which the FIGURE is a longitudinal diametrical cross-section along the axis of a loaded cartridge of the invention.

DETAILED DESCRIPTION

Referring to the FIGURE, a rimfire cartridge 10 is shown which comprises a shellcase 12, a bullet 14, a primer 16, a propellant powder 18 and a thin sheet 20 of densified propellant herein called a "foil." Specifically, the foil 20 is comprises of a nitrocellulose layer nitrated to greater than 13% by weight nitrogen in the nitrocellulose. The foil 20 of the invention is located above primer mix 16 at the base of shell 12 and serves to be sure that a portion of the propellant is always located adjacent the primer so that such portion will consistently and reliably ignite upon detonation of the primer, even where the cartridge is fired in a gun with the muzzle aimed downward where the loose propellant powder would otherwise be adjacent the bullet and instead of space 28 shown in FIGURE, the powder 18 would be located adjacent the rear end of "heel" **14*b* of bullet 14 so that there would be a space 30 between the primer 16 and propellant powder 18. Space 30 would be located below point 31 just above the primer 16. Without the foil in such a situation it is thought that the cartridge could misfire if the flame front from the primer detonation failed to cross space 30 well enough to reach point 31**. The foil thus allows the use of a somewhat less sensitive primer composition while still having good powder ignition.

The bullet 14, which has a front end or "nose" **14*a* and a rear end or "heel" 14*b***, is preferrably of solid copper so that no lead contamination of the air from the bullet is possible upon firing the ammunition containing the bullet.

The priming mix of the invention contains dinol as the initiating explosive, manganese dioxide as the oxidizer, tetrazene as the sensitizer and glass as the co-sensitizer and is intended for use in rimfire cartridges such as .22 caliber cartridges. The manganese dioxide-dinol combination is essential to the overall success of the dinol based primer mix because the $MnO_2$ provides the needed oxidizer strength to catalyze the reaction and has water insolubility for wet processing without being corrosive as are chlorate or prechlorate or other halogen-containing compounds.

The manganese dioxide concentration in the mix can range from about 10% up to about 40% by weight, with the particular concentration dependent on the relative concentrations of the other ingredients in the mix. A manganese dioxide concentration within the range of from about 15% to 25% is preferred.

The dinol partical size was found to be critical to success of the primer mix in rimfire cartridges. It has been found that the dinol particle size must be below 250 micron maximum dimension to ensure uniform performance. That is, the dinol particles should be small enough to pass through a screen having 250 micron openings. On such dinol particle is that made according to the procedure described in U.S. Pat. No. 2,408,059, issued to Olin Industries, Inc. (now Olin Corporation) entitled "Manufacture of Diaxodinitrophenol" and issued Sept. 24, 1946, the disclosure of which is incorporated herein by reference as if set forth at length. The '059 patent calls for use of an absorbed triphenylmethane dye as a crystal growth control agent.

The concentration of dinol in the mix is within the range of from about 25% up to about 40% by weight. The precise concentration of dinol is dependent on the amount of tetrazene, since those two ingredients provide the explosive energy to the mix. It is preferred that the combined weight percentages of dinol and tetrazene in the mix be within the range of from about 40% to about 60%.

The tetrazene can be standard commercial grade and is used in the mix in a concentration by weight within the range of from about 10% up to about 40% of the mix.

The glass can be standard rimfire glass (i.e. the same glass as used in conventional rimfire primers) and is used in the mix in a concentration by weight within the range of from about 10% up to about 30% of the mix.

The mixture can be made by a wet process, which is very desirable for rimfire applications where the primer is typically spun into the rim and the liquid flow properties are needed for uniformity of primer around the rim.

The advantage of the mix of the invention is that it contains no heavy metals such as lead or barium and thus is not toxic. A further advantage is that the mix is not corrosive. This is believed to be the first and only non-corrosive, non-toxic rimfire primer mix which can be safely and economically substituted for existing lead-containing and barium-containing rimfire primers without causing primer-related ammunition defects such as misfires, no-fires, hang fires and premature fires.

EXAMPLES

1. A priming composition was prepared by mixing water-desensitized dinol & tetrazene to form the premix to this premix was then added glass and manganese dioxide in layers. Subsequent thorough mixing completed the process. This mix had a composition of 30% by weight dinol, 30% by weight tetrazene, 20% manganese dioxide and 20% standard rimfire fine glass. This water wetted mix was applied into the rims of .22 LR cartridges in an amount calculated to give a dry primer mix charge weight of 0.2 grains. Over this mix was placed a nitrocellulose film having a dry weight of 0.2 grains. The nitrocellulose film was applied from a solution and then allowed a dry.

Sensitivity of the primed case with the mixture was tested by using Probst's method with a 1.94 ounce steel ball from measured heights varied by one inch increments. Twenty-five (25) primed cases were tested at 11" drop height and all fired without misfire. Using the Probst method, the average drop height for 50% fire ("H") was 4.9" with a standard deviation ("S") of 1.7" with $H+4S=11.7''$ and $H-2S=1.5''$.

For standard testing of safety, 100 shellcases primed with the composition are tested by dropping a 1.94 ounce steel ball from a height of one inch onto the rim of case. No detonations occur, thus indicating the cartridges are not overly sensitive. (A single detonation is considered a failure in this safety test.)

Ignition characteristics were tested by measuring pressure and velocity (P&V), Ignition Barrel Time (IBT) and pressure-time characteristics (P-T). The results were:

$V=1348$ fps $P=20{,}800$ psi $IBT=2.95$ ms when loaded into a standard LR .22 case with a 34 grain non-lead projectile and 2.8 grain of WC371 propellant.

Stability of the primer was tested by storing 20 rounds of .22LR caratridges having the priming mix composition and 20 rounds of standard .22LR cartridges were stored at 115 degrees F. at 85% relative humidity and at 70% degrees F. for 2 weeks and then fired to determine pressure and velocity. Pressure and velocity were not found to change significantly, thus the primer was judged stable.

The primer was next tested for function and casualty by shooting 100 rounds of .22LR cartridges primed with the priming composition and 100 rounds of standard .22LR cartridges in each of 5 types of .22 rifles used by the U.S. Government. Function and casualty were found to be equivalent to conventional primed cartridges. Function and casualty done five (5) months after loading were also found to be equivalent to conventional rounds with no change from values recorded in the prior results.

The net result of all of the testing was that the non-toxic, lead-free priming composition of the invention was found to be effective.

What is claimed is:

1. A method of producing a rimfire ammunition cartridge which comprises of steps of:

(a) introducing a quantity of non-toxic, non-corrosive, lead free priming material into an empty rimfire ammunition shell case;

(b) spinning the shell case so as to centrifugally force the priming material into a rim of the rimfire shell case;

(c) disposing a first quantity of solution of propellant in the interior of the base of the shell case adjacent to the centrifugally located primer material;

(d) evaporating the solvent from the solution of propellant so as to solidify the position of the first quantity of propellant sufficiently that it will remain adjacent to the priming material until the priming material is detonated:

(e) introducing a quantity of loose propellant powder into the interior of the shell case forward of the priming material and densified propellant material;

(f) sealing the open end of the shell case so as to confine the loose propellant there within.

2. The method of claim 1, wherein the step of sealing the open end of the shell case includes the step of seating a bullet in the open end.

3. The method of claim 2, wherein the bullet is of a copper material essentially free of lead.

4. The method of claim 2, wherein the bullet is of an aluminum material essentially free of lead.

5. The method of claim 1, wherein the densified propellant is nitrocellulose nitrated to at least 13% by weight nitrogen.

6. The method of claim 1, wherein the composition of the priming material is within the following ranges by weight:

diazodinitrophenol: 25%–40%
manganese dioxide: 10%–40%
tetrazene: 10%–40%
glass: 10%–40%

7. The method of claim 6, wherein the diazodinitrophenol has a particle size within the range from about 30 microns up to about 250 microns.

* * * * *